US006332286B1

(12) United States Patent
Shen

(10) Patent No.: US 6,332,286 B1
(45) Date of Patent: Dec. 25, 2001

(54) GUN TUBE CALIBRATOR

(75) Inventor: An-Jen Shen, Tau Yuan Hsien (TW)

(73) Assignee: Long Perng Co., Ltd., Taipei Hsien (TW)

( * ) Notice: Subject to any disclaimer, the term of this patent is extended or adjusted under 35 U.S.C. 154(b) by 0 days.

(21) Appl. No.: 09/576,123

(22) Filed: May 22, 2000

(51) Int. Cl.[7] ..... F41G 3/00

(52) U.S. Cl. ..... 42/121; 42/120; 42/121; 42/136

(58) Field of Search ..... 42/120, 119, 121, 42/122, 125, 135, 136

(56) References Cited

U.S. PATENT DOCUMENTS 2,367,288 * 1/1945 Klopp et al. .
3,112,567 * 12/1963 Flanagan ..... 42/121
3,908,282 * 9/1975 Steffan ..... 42/121
4,057,905 * 11/1977 Piaja ..... 42/121
4,534,116 * 8/1985 Davis .
5,150,527 * 9/1992 Knoster ..... 42/121
5,222,302 * 6/1993 Debatty et al. ..... 42/121
5,396,708 * 3/1995 Whitley ..... 42/121
5,486,913 * 1/1996 Aharon .
5,813,279 * 9/1998 Farley .
6,176,019 * 1/2001 Frear, Jr. ..... 42/120

* cited by examiner

*Primary Examiner*—Michael J. Carone
*Assistant Examiner*—Lulit Semunegus
(74) *Attorney, Agent, or Firm*—Dougherty & Troxell

(57) ABSTRACT

A gun tube cailibrator comprises a calibration lens, a sliding seat connected to the of the calibration lens, one side thereof is formed with a teeth track, and the center portion thereof is disposed with a vertical sliding groove for being locked horizontally by screws. The block is a rectangular body. and a side of the block near the sliding seat is formed with a respective teeth track engaged with the teeth track of the sliding seat, while the center thereof is installed with an axial hole. The lower end thereof is locked vertically by a fixing screw; An elastomer is installed between the teeth track of the block and the track of the sliding seat. A straight pin is inserted into a through hole in the center of the block and a fixing screw serves to the fixed the lower end thereof. Thus, the telescopic gun sight lens of different sizes can be suited. Therefore, above said gun tube calibrator can be applied to telescopic gun sight lenses of different sizes and a calibration head can be adjusted to a proper height.

2 Claims, 5 Drawing Sheets

GUN TUBE CALIBRATOR

BACKGROUND OF THE INVENTION

1. Field of The Invention

The present invention relates a gun tube calibrator, and especially to a gun tube calibrator comprising a calibration lens, a sliding seat, and a block, which can be adjusted according to the sizes of the gun tube calibrator to be linearly aligned with the front sight of a gun tube.

2. Description of the Prior Art

For calibrating the front sight of a prior art gun, a target is placed at a proper distance, then by shooting, the distance between the hole on the target and the center of the target is measured and then the displacement adjustment is performed according to the scale of a telescopic gun sight lens. Then a further shooting is performed to check whether the position of the hole on the target is matched with the center of the target. If a deviation is still existed, then the process is performed repeatedly until the hole is aligned with the center of the target.

However, such way for calibration the front sight of a gun is not effective, and not economical. Moreover, it is not matched the current tend.

In order to improve the above defects, some improvements of gun tube calibrator are developed, such as that shows in FIG. 1. The gun tube calibrator 1 includes a calibration lens 11, a fixing seat 12 being installed below the calibration lens 11, a through hole 13 being installed in the center of the fixing seat 12 for being inserted by a straight pin 14 of the gun tube. An adjusting screw 15 is installed at the lower end of the fixing seat 12 for fixing. In assembly, as that shown in FIG. 2, the straight pin 14 is inserted into the through hole 13 of the fixing seat 12. Then, an adjusting screw 15 serves to tighten and fix. In calibration, as shown in FIG. 13, another end of the straight pin is inserted into the gun tube 16 so that the calibration lens 11 is positioned at the upper end. Then, by the telescopic gun sight lens 17 original installed at the upper end of the gun tube, the calibration of the gun tube is achieved.

Although aforesaid gun tube calibrator provide a convenient way for calibrating a gun tube, there are many kinds of gun tube calibrators are invented, which have different sizes and specifications for matching the requirement of different telescopic gun sight lens. Not only the calibration work is complex, but also the manufacturing cost is high.

SUMMARY OF THE INVENTION

Accordingly, the primary object of present invention is to provide a gun tube calibrator comprising a calibration lens, a sliding seat and a block, Therefore, gun tube calibrator can be applied to telescopic gun sight lenses of different sizes and a calibration head can be adjusted to a proper height.

Another object of the present invention is to provide a gun tube calibrator. The defect in the prior art, such as different gun tube calibrators are necessary for suiting gun tubes of different sizes, is improved. Moreover, the cost is reduced greatly.

A further object of the present invention is to provide gun tube calibrator. It can be applied to telescopic gun sight lenses of different sizes. The calibration head can be adjusted to a proper height. Thus, the telescopic gun sight lens of different sizes can be suited. An optimum shooting rate can be adjusted. Therefore, the present invention is practical in use and is convenient.

The various objects and advantages of the present invention will be more readily understood from the following detailed description when read in conjunction with the appended drawing.

DESCRIPTION OF THE PREFERRED EMBODIMENT

Figures 1, 2:
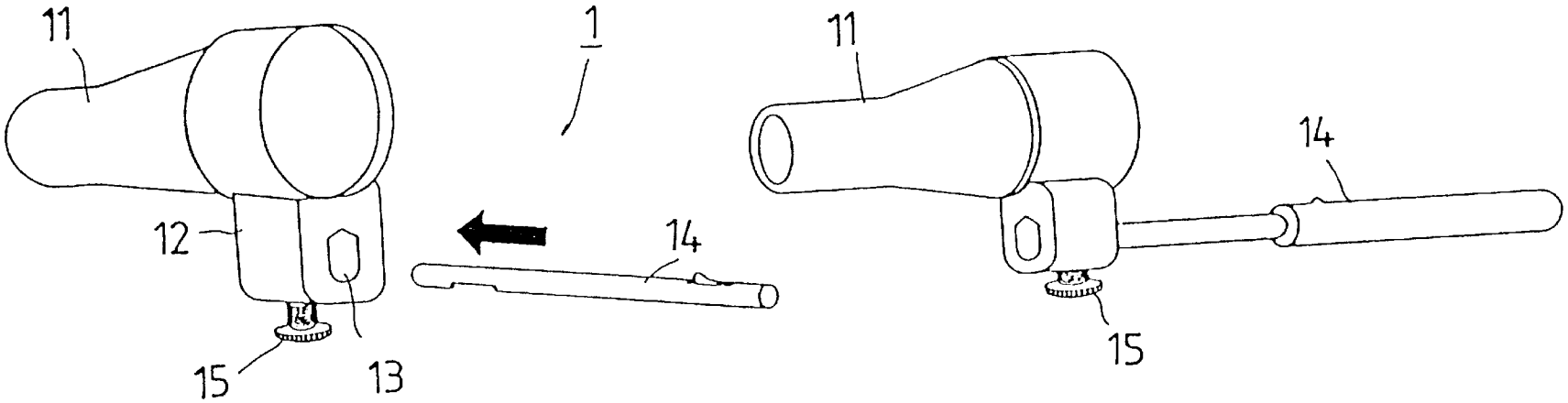
FIG. 1 shows a perspective view of a prior art gun tube calibrator
FIG. 2 is an assembled perspective view of a prior art gun tube calibrator.
Figure 3:
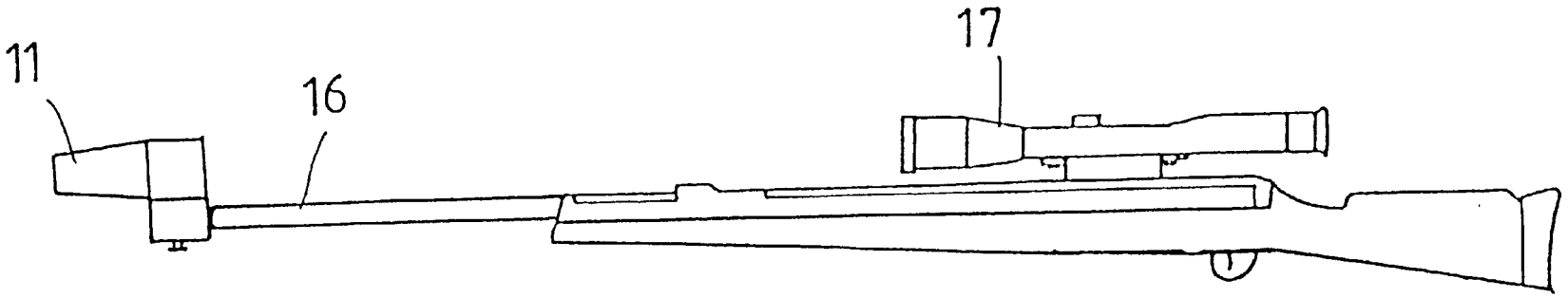
FIG. 3 is a schematic view showing a prior art gun tube calibrator.
Figure 4:
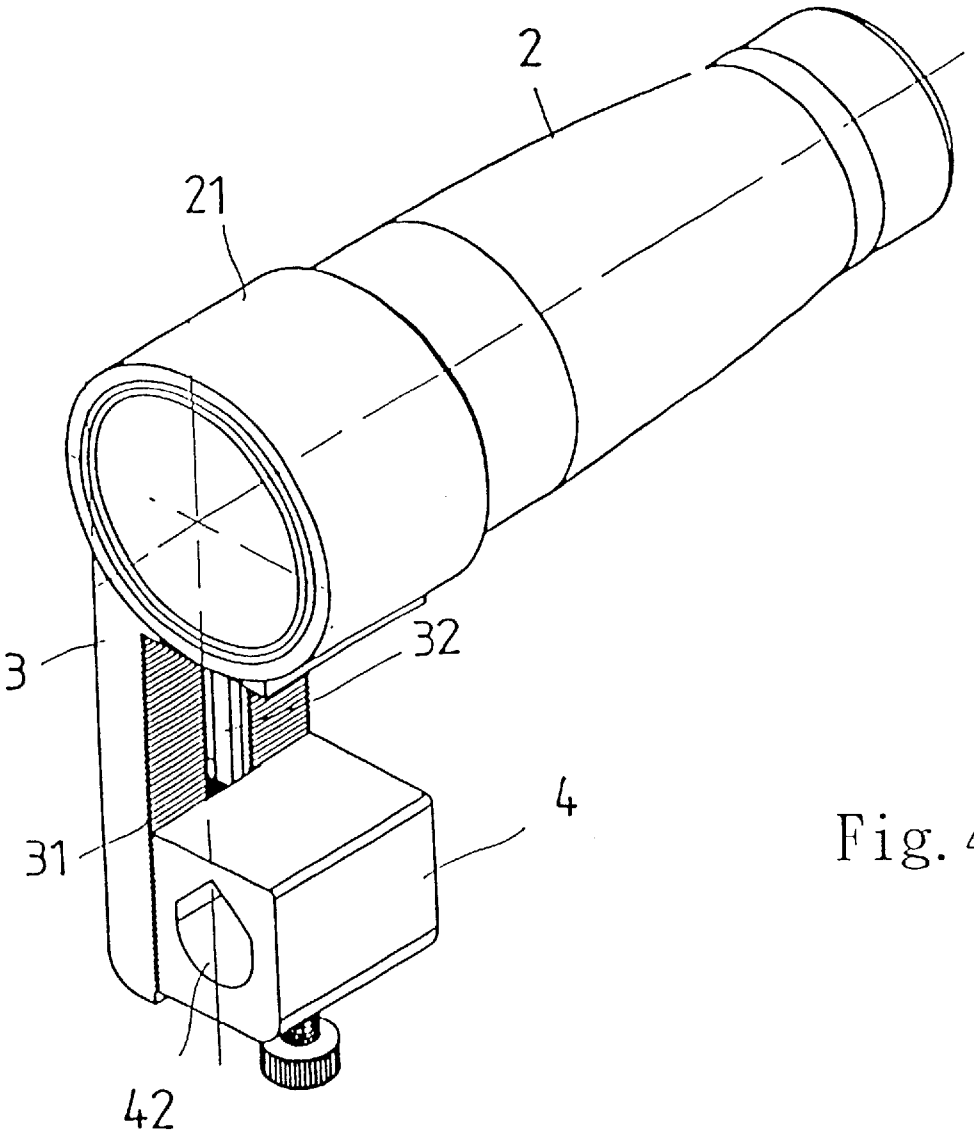
FIG. 4 is a schematic perspective view of the present invention.
Figure 5:
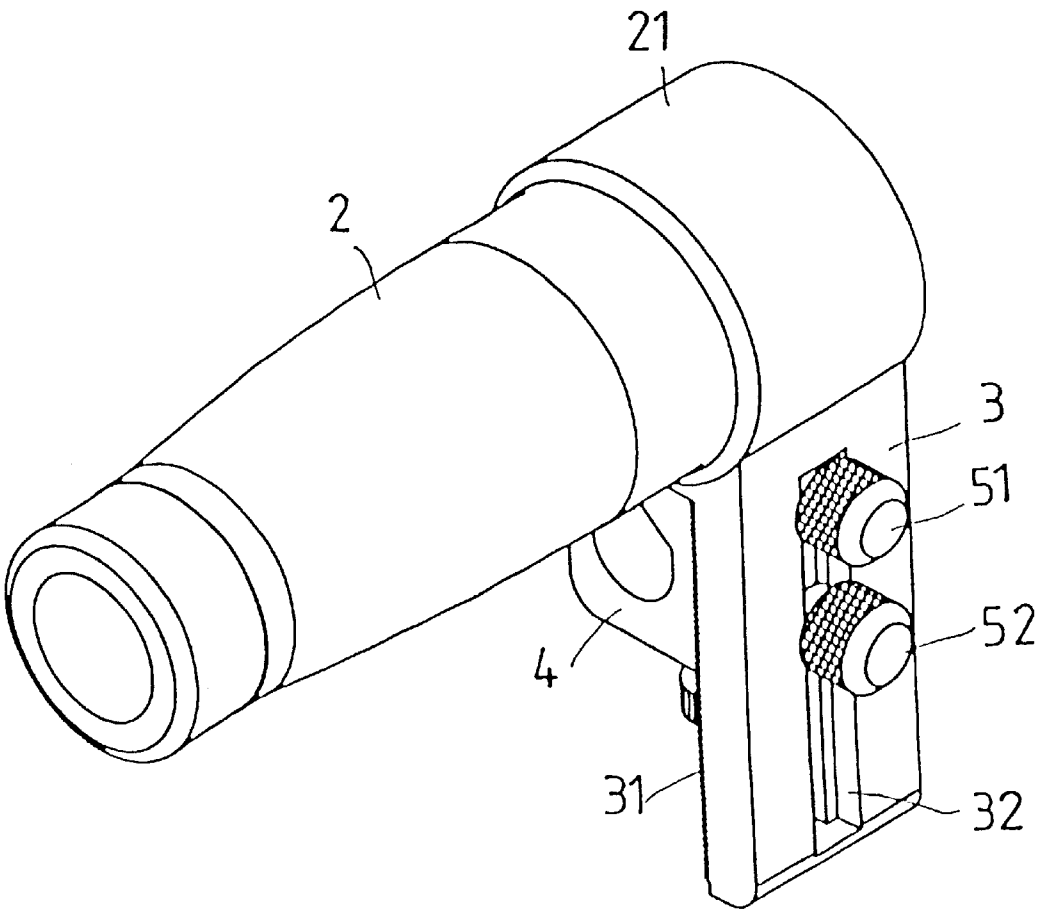
FIG. 5 is another schematic perspective view of the present invention which is viewed from a different visual angle.
Figure 6:
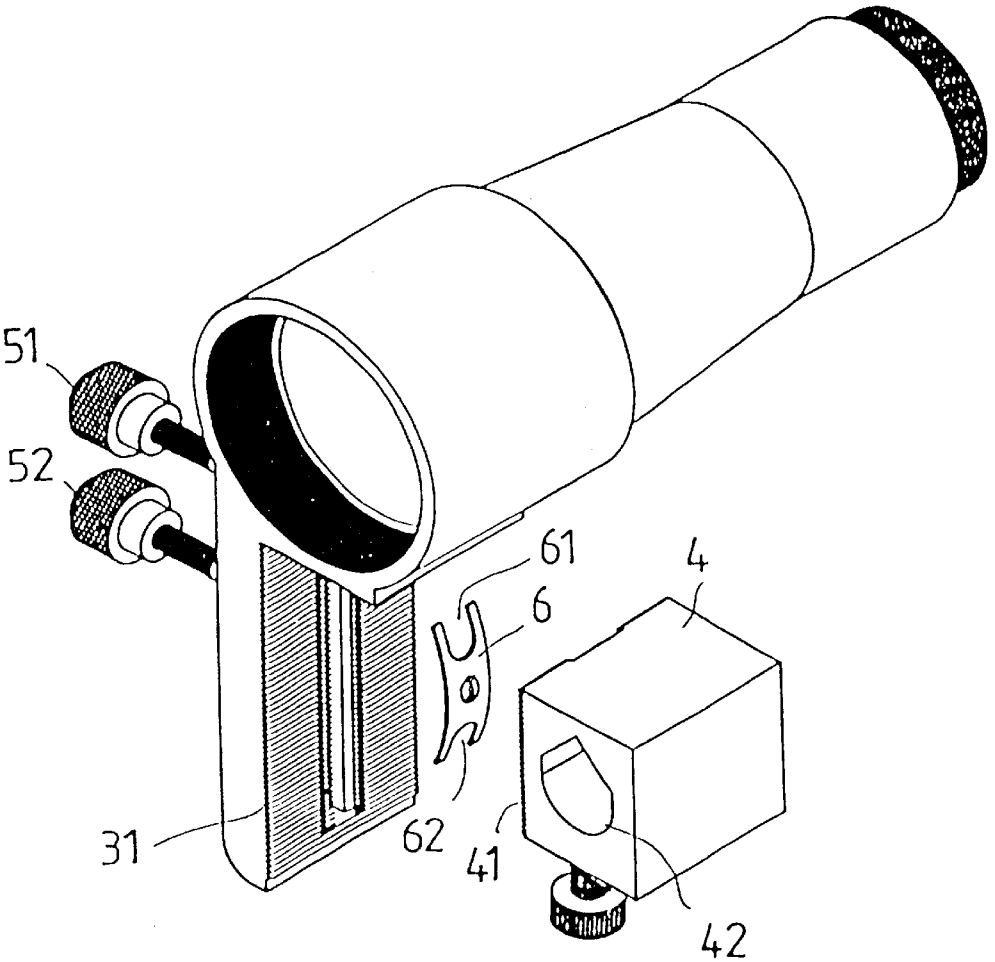
FIG. 6 is an exploded perspective view of the present invention.

With reference to FIGS. 4 and 5, the gun tube calibrator of the present invention is illustrated herein. The gun tube calibrator includes a calibration lens 2, a sliding seat 3 connected to the lower end of the calibration lens 2 and a block 4. The sliding seat 3 is integrated with the head 21 of the calibration lens. One side thereof is formed with a teeth track 31. The center portion thereof is disposed with a vertical sliding groove 32 for being locked horizontally by screws 51, and 52. The block 4 is a rectangular body, and one side thereof near the sliding seat 3 is formed with a respective teeth track 41 engaged with the teeth track 31, while the center thereof is installed with an axial hole 42. The lower end thereof is locked vertically by a fixing screw 43. Furthermore, an elastomer 6 is installed between the block 4 and the sliding seat 3. Referring to FIG. 6, the elastomer 6 has a cambered shape. The upper and lower ends thereof have respective notches 61 and 62 for being passed by the adjusting screws 51 and 52, respectively.

After the calibration lens of the present invention is assembled, similarly, by a straight pin (not shown) being inserted into a gun tube, telescopic gun sight lens of different sizes can be suited. Releasing the adjusting screws 51 and 52 and adjusting the position of the block 4 on the sliding seat 3, the telescopic gun sight lens and the gun tube calibrator can be adjusted to be at the same horizontal level. By the installation of the teeth track 41, the respective teeth track 41, and the elastomer 6, the assembly of the block 4 and the sliding seat 3 are fixed firmly without releasing due to shooting. The calibration work is more practical. The present invention can be applied to telescopic gun sight lenses of different sizes. Therefore, the design of the present invention is flexible and convenient and the manufacturing cost is reduced.

In summary, The present invention can be applied to telescopic gun sight lenses of different sizes. The calibration head can be adjusted to a proper height. The defect in the prior art, such as different gun tube calibrators are necessary for suiting gun tubes of different sizes, is improved.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A gun tube calibrator comprising a calibration lens, a sliding seat connected to the lower end of the calibration lens and a block, wherein the sliding seat is integrated with a head of the calibration lens; one side thereof is formed with a teeth track; a center portion thereof is disposed with a vertical sliding groove for being locked horizontally by screws; a side of the block near the sliding seat is formed with a respective teeth track engaged with the teeth track of the sliding seat, while the center thereof is installed with an axial hole; the lower end thereof is locked vertically by a fixing screw; therefore, above said gun tube calibrator can be applied to telescopic gun sight lenses of different sizes and a calibration head can be adjusted to a proper height.

2. The gun tube calibrator as claimed in claim 1, wherein an elastomer is installed between the teeth track of the block and the track of the sliding seat; the elastomer has an cambered shape; further, the elastomer has notches for being passed by the adjusting screws so that the conbination of the block and the sliding seat are tight.

* * * * *